US010297118B2

(12) United States Patent
Chun et al.

(10) Patent No.: US 10,297,118 B2
(45) Date of Patent: May 21, 2019

(54) APPARATUS AND METHOD FOR PROCESSING DATA BETWEEN NEIGHBORS TO PREVENT DISPUTE OVER NOISE TRAVELLING BETWEEN NEIGHBORS

(71) Applicants: Sungpil Chun, Seongnam-si (KR); Yongseob Lim, Daegu-si (KR)

(72) Inventors: Sungpil Chun, Seongnam-si (KR); Yongseob Lim, Daegu-si (KR)

( * ) Notice: Subject to any disclaimer, the term of this patent is extended or adjusted under 35 U.S.C. 154(b) by 0 days.

(21) Appl. No.: 15/696,878

(22) Filed: Sep. 6, 2017

(65) Prior Publication Data

US 2018/0068535 A1 Mar. 8, 2018

(30) Foreign Application Priority Data

Sep. 6, 2016 (KR) ..... 10-2016-0114697

(51) Int. Cl.
*G08B 5/22* (2006.01)
*G08B 5/36* (2006.01)
*G08B 21/22* (2006.01)

(52) U.S. Cl.
CPC ..... *G08B 5/225* (2013.01); *G08B 5/36* (2013.01); *G08B 21/22* (2013.01)

(58) Field of Classification Search
CPC ..... G08B 5/225; G08B 5/36; G08B 21/22
See application file for complete search history.

(56) References Cited

U.S. PATENT DOCUMENTS 8,259,957 B2 9/2012 Frohlich et al.
2008/0144838 A1 6/2008 Raines et al.

FOREIGN PATENT DOCUMENTS

KR 10-1307172 B1 9/2013
KR 10-1308338 B1 9/2013
KR 10-1456363 B1 10/2014
KR 10-2014-0144454 A 12/2014
KR 10-2015-0087464 A 2/2016

*Primary Examiner* — Brian E Miller
(74) *Attorney, Agent, or Firm* — Sughrue Mion, PLLC

(57) ABSTRACT

An apparatus and method for processing data between neighbors are provided. The apparatus may include the first and second communication devices. The first communication device in a first space includes a first processor that receives and processes information on a state of a first neighbor from an input interface and transmits a resultant state of the first neighbor to a display unit. The second communication device, in a second space spatially separated from the first space, includes a communication unit that communicates data with the first communication device, and a display unit that simultaneously displays the resultant state of the first neighbor transmitted from the first communication device. The resultant state of the first neighbor represents a degree of tolerance by the first neighbor over noise travelling between floors. The present invention provides an apparatus and method for processing data between spatially apart neighbors in order to prevent neighborly dispute over noise travelling between floors commonly occurring in multi-unit dwellings such as apartments in a mutually considerate, communicative and friendly manner.

20 Claims, 9 Drawing Sheets

500

【FIG. 1】
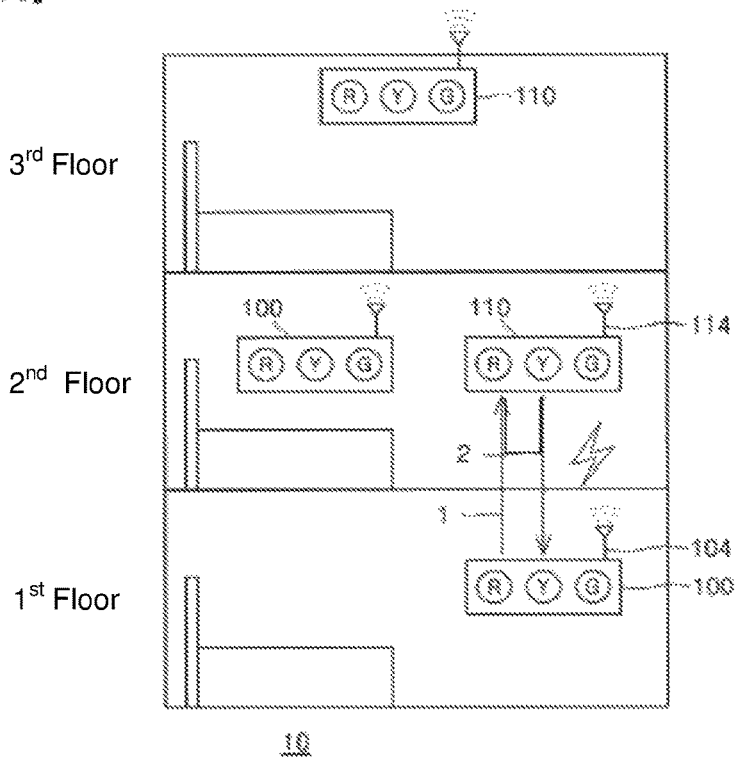
【FIG. 2】
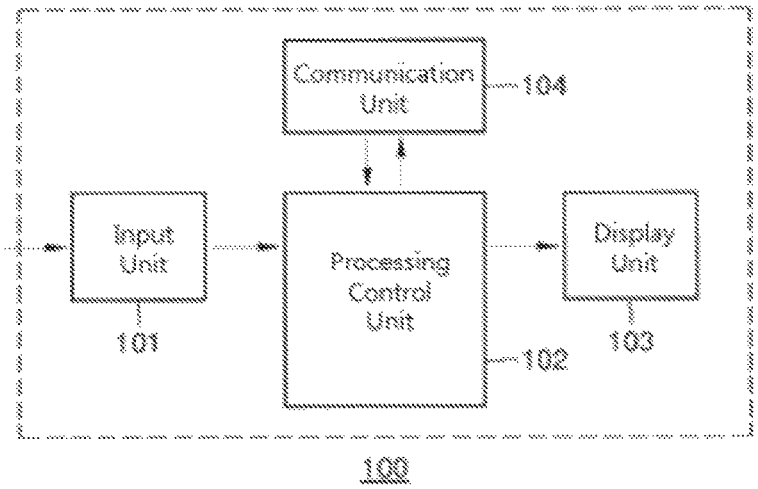

【FIG. 3A】
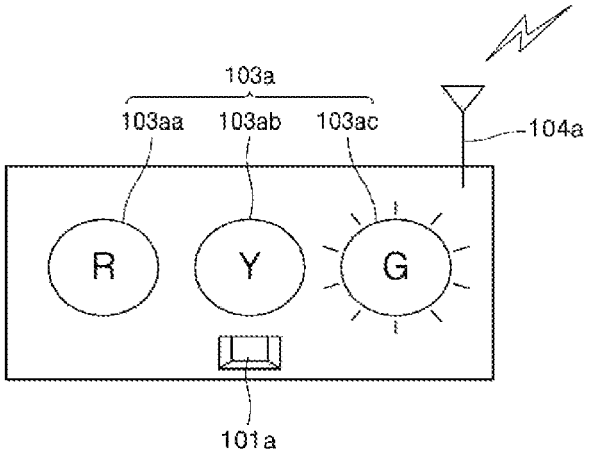
【FIG. 3B】
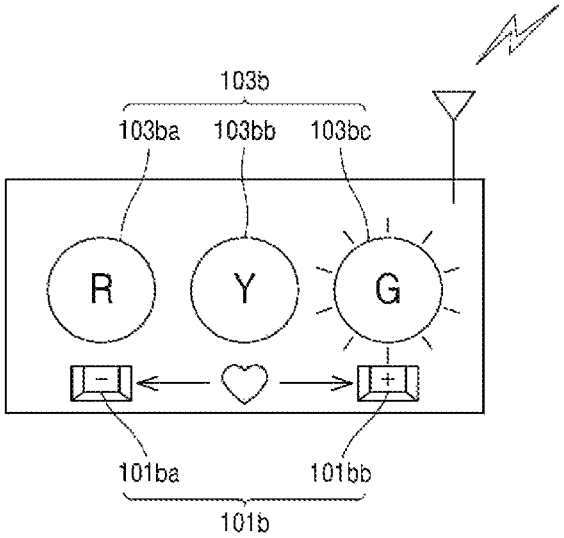
【FIG. 3C】
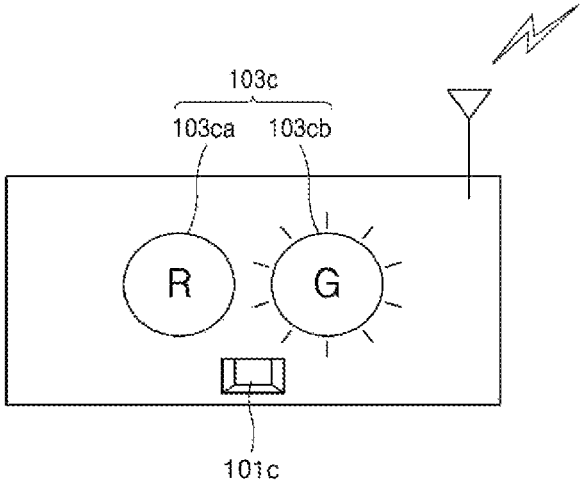

【FIG. 3D】
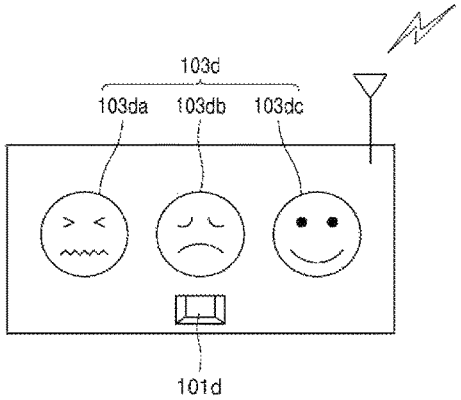
【FIG. 3E】
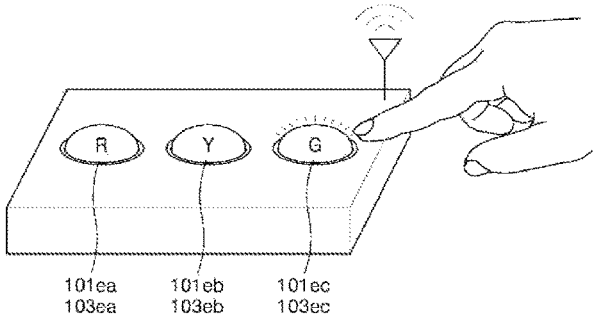
【FIG. 4】
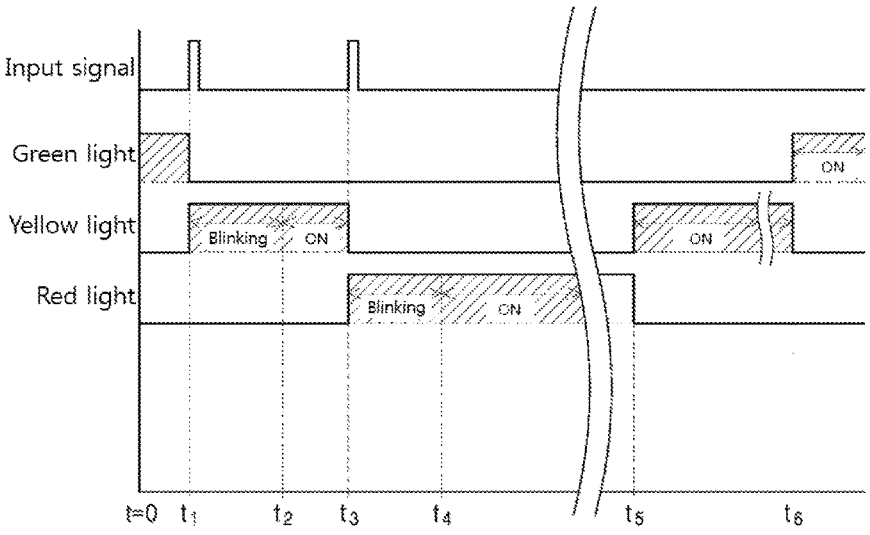

【FIG. 5A】
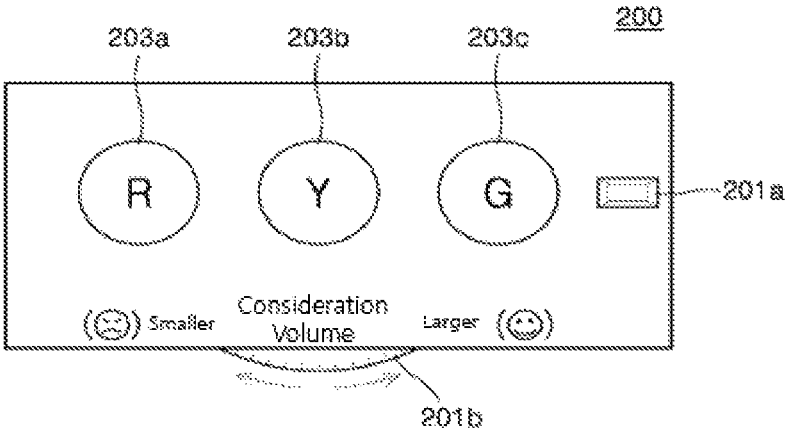
【FIG. 5B】
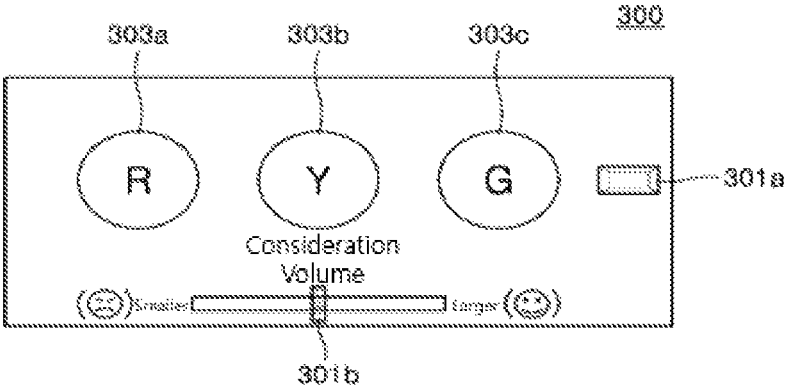

【FIG. 6】
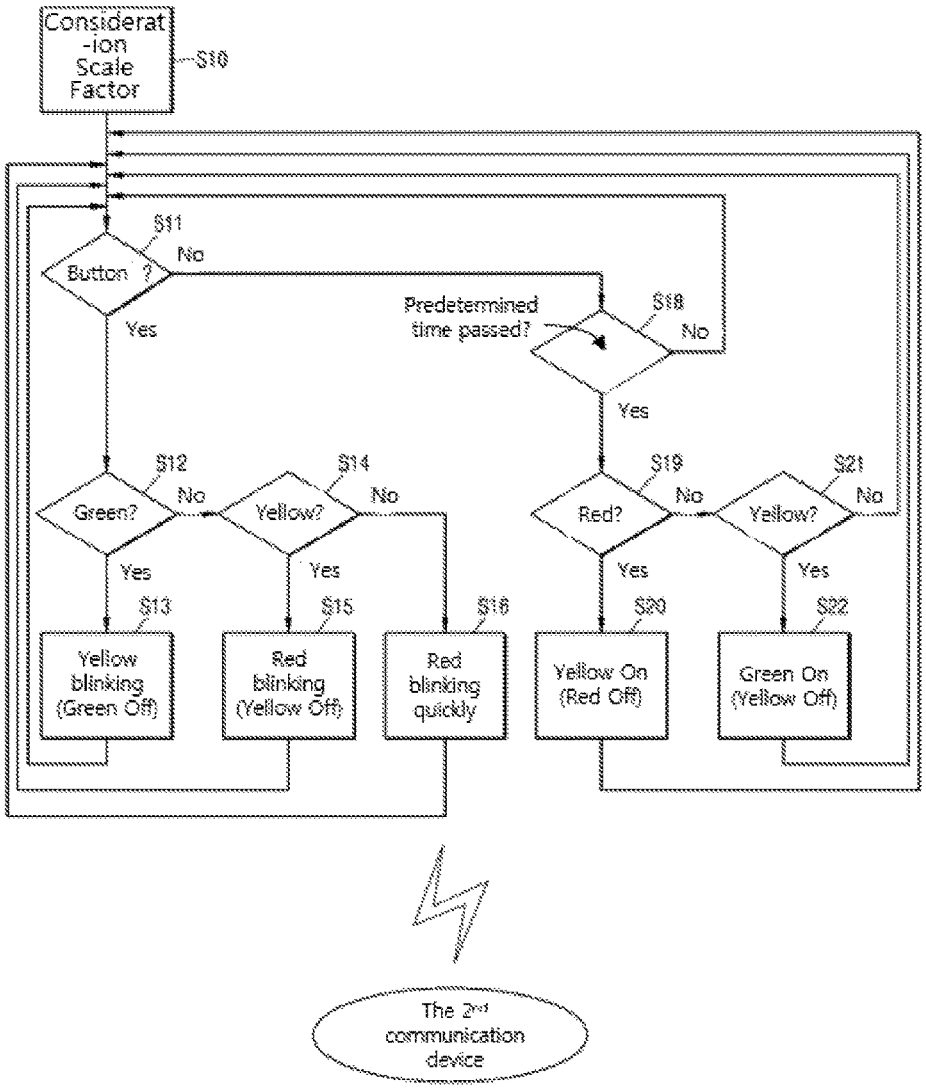

【FIG. 7】
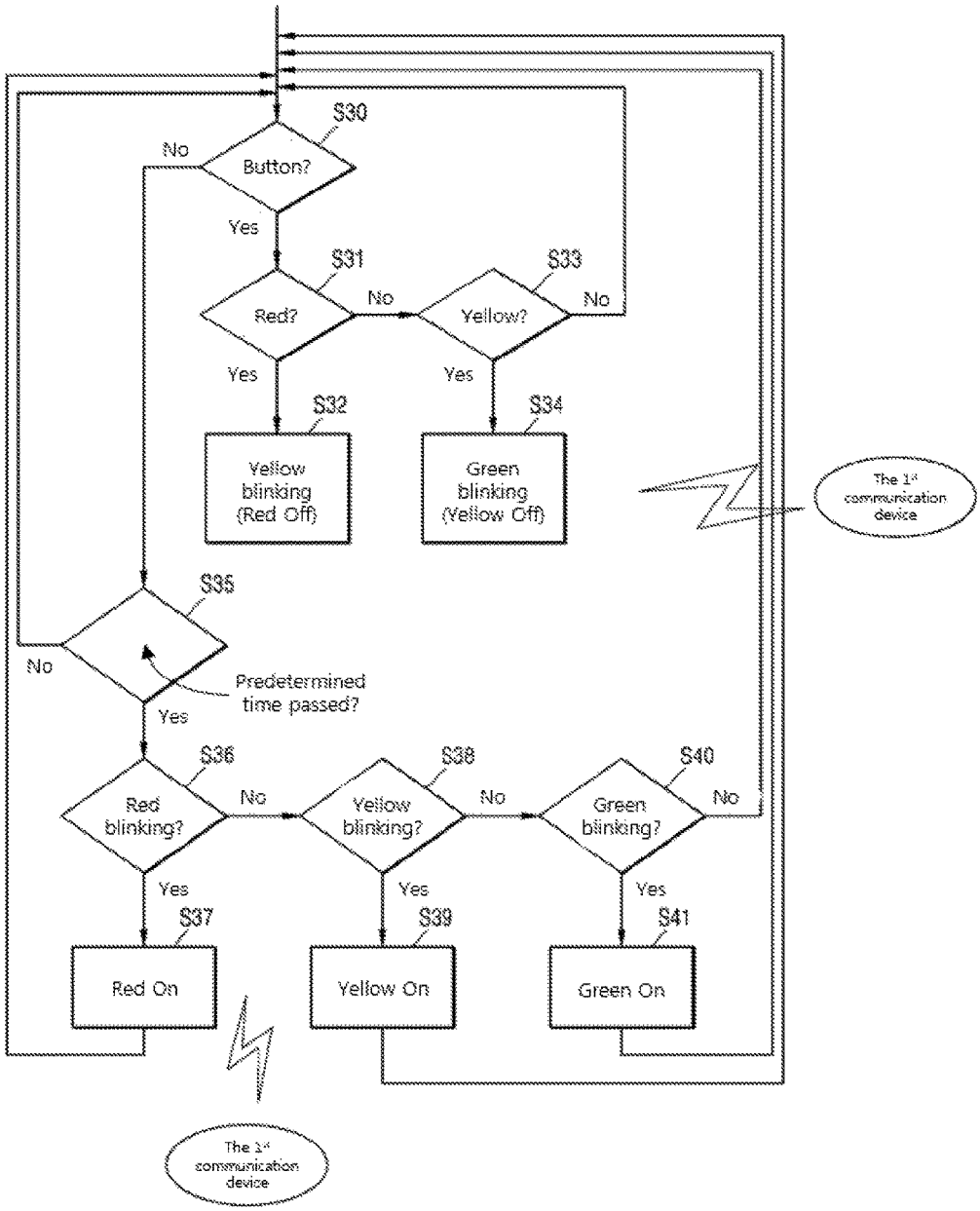

【FIG. 8】
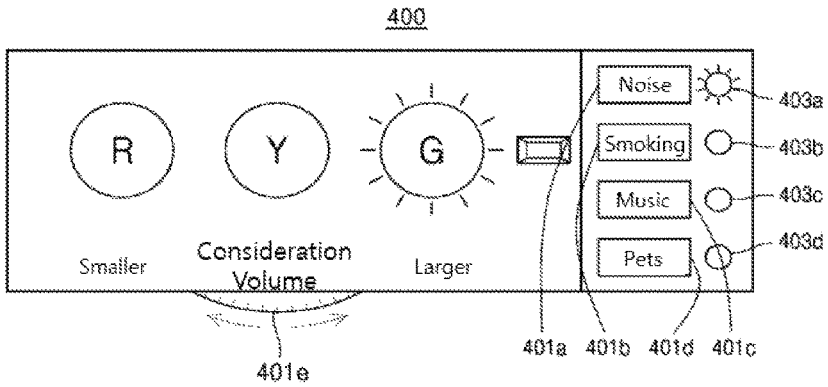
【FIG. 9】
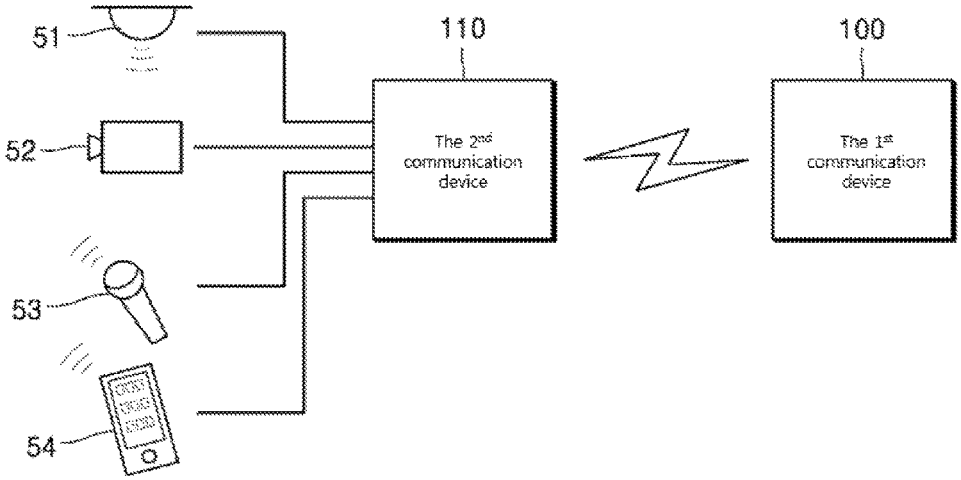

【FIG. 10】
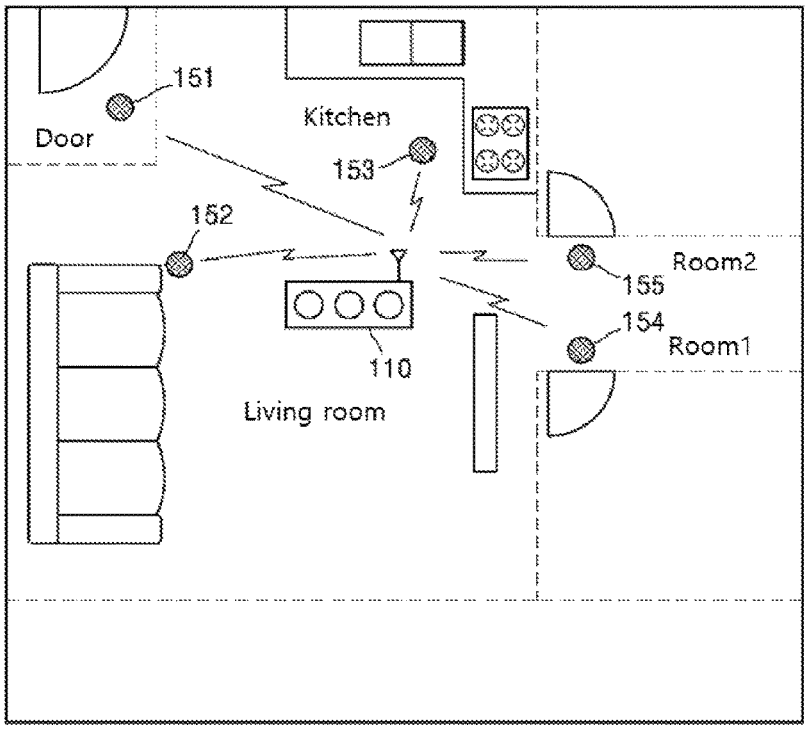
Upper Floor

【FIG. 11】
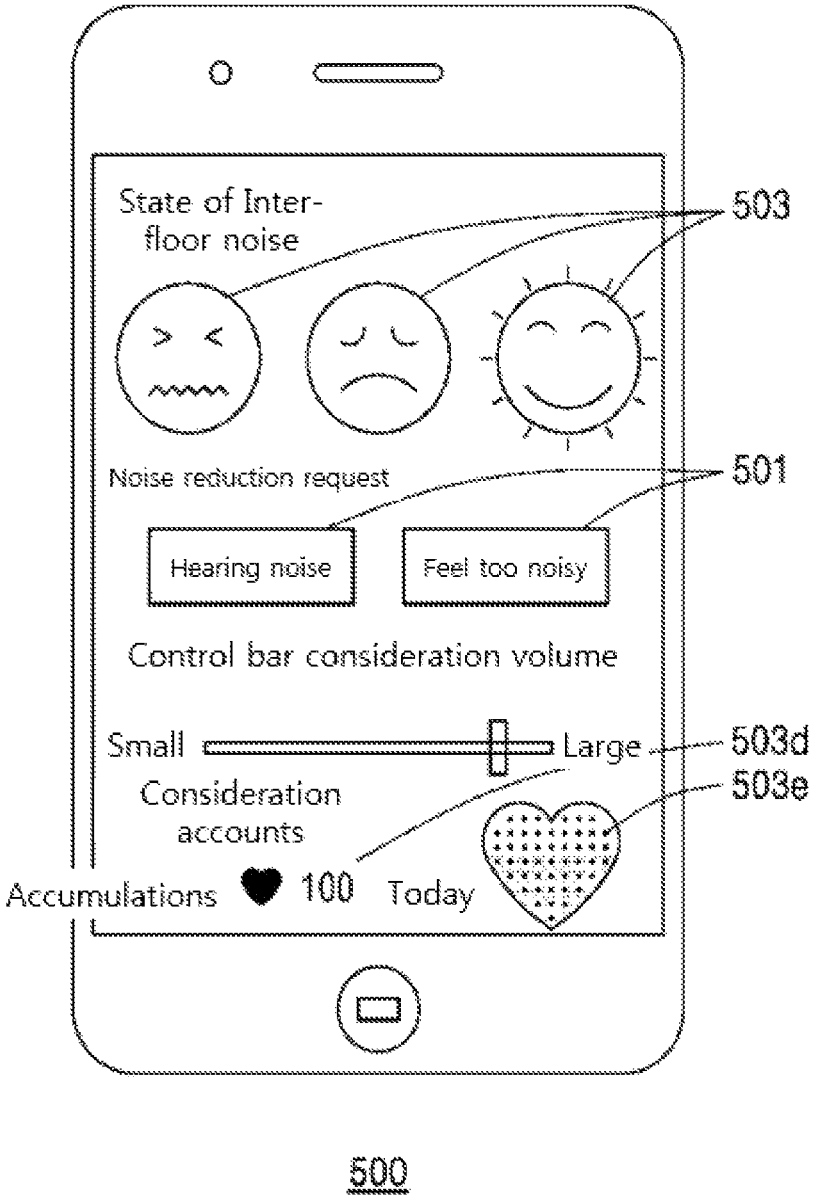

APPARATUS AND METHOD FOR PROCESSING DATA BETWEEN NEIGHBORS TO PREVENT DISPUTE OVER NOISE TRAVELLING BETWEEN NEIGHBORS

CROSS-REFERENCE TO THE RELATED APPLICATION

This application claims priority from Korean Patent Application No. 10-2016-0114697, filed on Sep. 6, 2016, in the Korean Intellectual Property Office, the disclosure of which is incorporated herein in its entirety by reference.

BACKGROUND

1. Field

Apparatuses and methods consistent with exemplary embodiments relate to processing data between neighbors for preventing neighborly dispute over noise travelling between neighbors through mutual consideration and efficiently solving the dispute.

2. Description of the Related Art

As a result of becoming a metropolitan city, the proportion of residential apartments such as apartments is increasing. Disputes and mental stress caused by the noise travelling between neighbors in multi-unit dwellings such as apartments have recently become a big social problem. Downstairs residents of apartment suffer from physical and mental suffering due to noise travelling between neighbors. On the other hand, upstairs residents suffer from psychological anxiety and mental stress due to frequent complaints from downstairs residents. There are also arguments over cause of noise between family members living upstairs.

The survey shows the patterns (percentile) of noise between neighbors as follows: noise of kids-running (36%), machine noise (18%) such as TV and washing machine, noise of walking (16%), sound of musical instruments such as piano (9%) and the sensitivity of the neighbors (5%).

In Korea, various methods have been proposed to solve this problem. In order to reduce noise between neighbors of a new apartment, the thickness of the inter-floor beam is increased or the noise shielding material is installed between the floors. This construction method is not widely adopted because it increases construction cost and it is impossible to apply it to existing apartments. On the other hand, in order to reduce the noise between neighbors of an existing apartment, there is a case where a buffer pad is placed on a floor of rooms. Also, in order to address this problem, several patent publications have been proposed as follows: Korean Patent No. 1548932 (Floor Pad for Preventing Noise between neighbors), Korean Patent No. 1142119 (Structure and Method for Construction of Floors of Apartments), Korean Patent No. 1266318(Apparatus for Measuring and Alarming of Vibration and Noise between neighbors), Korean Patent Publication No. 20150078964 (Apparatus for Alarming of Noise between neighbors in Multi-unit Dwellings) and Korean Patent No. 1582899 (Method, System, Recording Medium and File Distribution System for Exchange Information for Neighborly Communication).

In addition, as disclosed in U.S. Pat. No. 8,359,957 and U.S. Patent Publication No. 20080144838, a noise measuring device is installed in a space where the noise between neighbors travels, and the noise is measured and conveyed to a resident causing the noise so as to inform the resident of the noise level. Advantageously, it can make an upstairs resident causing the noise aware of the noise level travelling to its neighbor. However, since it is mere a notice of the noise level to the upstairs resident causing the noise, it is nothing but refraining the upstairs resident from causing further noise, and it is lack of mutual consideration of neighbors between neighbors in order to relieve stress from causing the noise. In addition, since a microphone or a speaker is required to be installed downstairs, the installation is costly and burdensome, and it is difficulty setting appropriate limit of tolerance as to the noise. Furthermore, it is disadvantageous that this method cannot discern the noise between neighbors from miscellaneous noise from the other source.

SUMMARY

One or more exemplary embodiments of the inventive concept include a system and method for processing data between neighbors through mutual consideration of neighbors between neighbors in order to address neighborly feud over the noise travelling between neighbors in multi-unit dwellings such as apartments in a friendly and communicative manner based on caring for each other, not in an offensive and insulting manner.

Various aspects of the inventive concept will be set forth in part in the description which follows and, in part, will be apparent from the description, or may be learned by practice of the presented exemplary embodiments.

According to one or more exemplary embodiments, there is provided an apparatus for processing data between neighbors according to an embodiment of the present invention may include the first and second communication devices. The first communication device in a first space may include a first processor that receives and processes information on a state of a first neighbor from an input interface and transmits a processed state of the first neighbor to a display unit. The second communication device, in a second space spatially separated from the first space, may include a communication unit that communicates data with the first communication device, and a display unit that simultaneously displays the processed state of the first neighbor transmitted from the first communication device. The processed state of the first neighbor may represent a degree of tolerance by the first neighbor over noise travelling between neighbors.

The processed state of the first neighbor may be an indicator of the degree of tolerance or consideration by downstairs resident as to such inconveniences as noise travelling between neighbors, companion animal sounds, smoking, musical sounds, etc. occurring upstairs.

A communication system according to another embodiment of the present invention may comprise a set of pairing communication devices which communicate with each other and display a processed state of spatially separated neighbors in the first and second spaces on each pairing communication device at the same time. The first neighbor downstairs may share the processed state representing a degree of tolerance as to noise travelling between neighbors with a second neighbor upstairs by transmitting and displaying the processed state to the second neighbor through the set of pairing communication devices.

An apparatus for processing data between neighbors according to another embodiment of the present invention may comprise the first communication device which receives information of a state of the first neighbor in lower floor and transmits a processed state of the first neighbor to the second communication device. The processed state of the first neighbor may indicate a limit of tolerance by the downstairs resident as to noise travelling between neighbors. Here, the second device is operatively coupled to the first communication device for data communication and may receive the feedback signal to the processed state of the downstairs resident from the upstairs resident in order to transmit the feedback signal to the first communication device.

According to one or more exemplary embodiments, there is provided a method of processing data between neighbors according to another embodiment of the present invention is provided. This embodiment may include the step of receiving, by a first communication device, information on a state of a first neighbor relating to a current state of the first neighbor through an input interface. This method may also include the step of processing, by the first communication device, the information on the state of the first neighbor into a processed state of the first neighbor through a processor. This method may also include the step of displaying and transmitting, by the first communication device, the processed state of the first neighbor through a display unit and a communication unit respectively. This method may also include the step of receiving the processed state of the first neighbor by a second communication device communicatively connected with the first communication device at a spatially separated location. This method may also include the step of displaying, by the second communication device, the processed state of the first neighbor at the same time as the first communication device display that same processed state.

According to the present invention, a downstairs resident can acquire quietness by conveniently and promptly transmitting a request for refraining from causing the noise between neighbors to an upstairs resident when feeling in the mood for being quiet and cared by the upstairs neighbor as much as the downstairs resident has been considerate for the upstairs neighbor other times. Meanwhile, the upstairs resident can easily recognize whether the downstairs neighbor is in considerate mode or not. Thus, in the considerate mode, it is possible to be relieved from stress from causing the noise between neighbors. On the other hand, since noise generation will have to be refrained only in the non-considerate mode, dissonance between upstairs family members resulted from unnecessary pushing for refraining from generating the noise can be prevented. In addition, in case that the noise source is not the person on the upper floor but the downstairs neighbor changes the processed state by mistake or misunderstanding, the upstairs resident can give the feedback to the downstairs neighbor that the noise source is not him or her, thus it is possible to eliminate unnecessary misunderstandings between neighbors.

BRIEF DESCRIPTION OF THE DRAWINGS

These and/or other aspects will become apparent and more readily appreciated from the following description of exemplary embodiments, taken in conjunction with the accompanying drawings, in which:

FIG. 1 is a schematic view illustrating an apparatus for processing data between neighbors and its installation place, according to an exemplary embodiment;

FIG. 2 is a schematic view illustrating an internal configuration of the first communication device, according to an exemplary embodiment;

FIGS. 3A through 3E are schematic view illustrating the first communication devices, according to an exemplary embodiment and modifications thereof;

FIG. 4 is a timing chart showing an operation mode according to the input signal of the first communication device, according to an exemplary embodiment;

FIGS. 5A and 5B is a schematic view illustrating the first communication devices, according to another exemplary embodiment and modification thereof;

FIG. 6 is a flowchart showing the operation of the apparatus for processing data between neighbors shown in FIG. 5*a* with the first communication device, according to an exemplary embodiment;

FIG. 7 is a flowchart showing the operation of the apparatus for processing data between neighbors shown in FIG. 5*a* with the second communication device, according to another exemplary embodiment; and FIG. 8 is a schematic view illustrating the first communication device, according to another exemplary embodiment.

FIG. 9 is a schematic view illustrating a connection relationship between the second communication device and sensors, according to another exemplary embodiment.

FIG. 10 is a schematic view illustrating a state where IoT (Internet of Things) sensors are installed in a space of a floor where the second communication device is installed, according to another exemplary embodiment.

FIG. 11 is a schematic view illustrating a first communication device (i.e., including a portable device or a smartphone capable of communication), according to another exemplary embodiment.

DETAILED DESCRIPTION

Reference will now be made in detail to exemplary embodiments which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the drawings, to explain various aspects of the inventive concept. As used herein, the term "and/or" includes any and all combinations of one or more of the associated listed items.

Hereinafter, the exemplary embodiments will be described with reference to the accompanying drawings. In the drawings, like reference numerals denote like elements, and overlapping descriptions thereof will be omitted.

In the following description, the technical terms are used only for explaining one or more exemplary embodiments while not limiting the inventive concept. The terms of a singular form may include plural forms unless referred to the contrary. The meaning of 'include' or 'comprise' specifies a property, a fixed number, a step, a process, an element, a component, and a combination thereof but does not exclude other properties, fixed numbers, steps, processes, elements, components, and combinations thereof. It will be understood that although the terms "first" and "second" are used herein to describe various elements, these elements should not be limited by these terms. Terms are only used to distinguish one element from other elements.

Referring to FIG. 1, the first communication device 100 of the present invention is installed in a lower floor, and the second communication device 110 is installed in an upper floor.

The first communication device 100 receives and processes information regarding the status of the first neighbor to display and transmits the processed state of the first spatial neighbor. The first communication device 100 illustrated in FIG. 2 includes an input unit 101, a processing control unit 102, a display unit 103, and a communication unit 104.

The input unit 101 is configured to receive a signal related to the status of the lower floor neighbor. Examples of the status of the lower floor neighbor may be one of a state of absence, a state of care while staying in (hereinafter referred to as "staying-in & considerate mode"), or a state of requesting for noise reduction while staying in (hereinafter referred to as "non-considerate mode").

The request for noise reduction can occur when a signal is input directly from a lower-level neighbor, through a remote control, or through a smartphone application. The absence state or the care-mode state may occur when no signal is input to the input unit 101.

As another embodiment, signals from various sensors from IoT (Internet of Things) installed downstairs may be processed to determine the processed state of the downstairs neighbor.

For example, the IoT (Internet of Things) sensor may receive a detection signal from a motion detection sensor such as a PIR sensor, a sound detection sensor, or a motion detection camera through video analysis. In this case, when there is no output signal from the detection sensor, it is recognized as an absence state, and when there is an output signal, it will be recognized as a state in which residents are staying in. If there are any additional input signals, it can be recognized as a request for noise reduction from the lower floor, otherwise it can be recognized as the care-mode.

As another embodiment, the input unit 101 corresponding to each state may be provided. For example, the processing control unit 102 can recognize the corresponding state by each input.

The processing control unit 102 receives information on the state of the lower floor neighbor input through the input unit 101 and processes it into the processed state, then transmits it to the display unit 103.

The display unit 103 displays the processed state of the lower floor neighbor. The display unit 103 may be configured by various means.

As an embodiment, the display unit 103 is composed of a green lamp 103*cb* and a red lamp 103*ca* indicating two state modes. In this case, the green light 103*cb* indicates the considerate mode, and the red light 103*ca* indicates the non-considerate mode. The considerate mode means a state of absence or careful consideration which means to let the people in the upper floor stay freely without worrying about making noise. In the non-considerate mode, the upstairs resident is requested to be refrained from making the noise.

In another embodiment, the display unit 103 is composed of three state modes, for example, a green light 103*ac*, a yellow light 103*ab*, and a red light 103*aa*. In this case, the green lamp 103*ac* is turned ON when the lamp is in the absence state or in the state of staying-in & considerate mode, while the yellow lamp 103*ab* and the red lamp 103*aa* are turned ON in the case of non-considerate mode.

Alternatively, the green lamp 103*ac* may be configured to indicate the absence state, the yellow lamp 103*ab* may indicate the state of the staying-in & considerate mode, and the red lamp 103*aa* may indicate the state of the non-considerate mode. However, in this exemplary, private information such as whether presence or absence is directly exposed to the upstairs neighbor.

Referring to FIG. 3, it will be described how the state information of the first spatial neighbor input to the input units 101*a*, 101*b*, 101*c*, 101*d*, and 101*e* is processed by the processing control unit 102 and then displayed in the display unit 103 as the state mode, which is a processed state of the first spatial neighbor.

In FIG. 3*a*, the display unit 103*a* includes a red light 103*aa*, a yellow light 103*ab*, and a green light 103*ac*. The input unit includes one input button 101*a*. When there is no input from the user in the input unit 101*a*, the green light 103*ac* is ON in default.

When the input is received in the input unit 101*a* during the state of the green light 103*ac*, the processed state turns the yellow light 103*ab* ON. When the input is received again, the processed state turns the red light 103*aa* ON. In an embodiment where only one input button 101*a* exists, the mode is changed toward the considerate mode in a sequential order as no additional input is received. For example, when there is no input for 30 minutes in the state of the red light 103*aa*, the processed state turns the yellow light 103*ab* ON.

In FIG. 3*b*, the display unit 103*b* includes a red light 103*ba*, a yellow light 103*bb*, and a green light 103*bc*. The input unit 101*b* includes two input buttons 101*ba* and 101*bb*. The (−) button 101*ba* on the right side changes the mode toward the considerate mode, while the (+) input button 101*b* on the left changes the mode toward the non-considerate mode. When the state mode is the yellow light 103*bb* ON, the (−) button 101*ba* allows the red light 103*ba* to be ON, on the other hand the (+) button allows the green light 103*bc* to be ON. With both (+) and (−) buttons, the state mode can be instantaneously changed as compared with the display unit 103*a* shown in FIG. 3*a*.

In FIG. 3*c*, the display unit 103*c* may be composed of only the red light 103*ca* and the green light 103*cb*. The green light 103*cb* may correspond to either of the absence state mode or the staying-in & considerate mode. The red light 103*ca* may correspond to the non-considerate mode, i.e. the noise reduction request mode while staying-in. When the state mode is the green light 103*cb*, the red light 103*c* is turned on when an input is received from the lower floor. The green light 103*cb* will be turned on when no input is received for a predetermined time with the red light 103*c* ON.

As another embodiment, as shown in FIG. 3*d*, the state mode may be represented by an icon or the like. A green light 103*dc*, a yellow light 103*db* and a red light 101*da* respectively may be superimposed on the icon 103*dc* such as a smiling face 103*dc*, broken face 103*db* and the annoyed face 103*da*, respectively. Accordingly, the processed state of the downstairs neighbor can be intuitively recognized.

Referring to FIG. 3*e*, as another embodiment of the display unit 103 and the input unit 101, it is characterized in that the input unit 101*e* and the display unit 103*e* are integrally formed. For example, when the green lamp 101*ec* is pressed, the green light is turned on. When the yellow lamp 101*eb* is pressed, the yellow light is turned on. When the red lamp 101*ea* is pressed, the red light is turned on. For doing so, an electrical circuit can be formed below each of the lamps.

The communication unit 104 sends a signal relating to the processed state of the lower floor neighbor outputted from the processing control unit 102 to the communication unit 114 of the second communication device 110. The communication units 104 and 114 may be implemented in various ways, for example, Zigbee, Wi-Fi, and Bluetooth of the wired or wireless communication.

The first communication device 100 and the second communication device 110 are configured to be securely connected to each other to exchange information only between the devices. Thus, it is possible to prevent state information on my living space from being leaked to a third party, and to obtain information on the state of my neighborhood only.

The communication units 104 and 114 of the first and second communication devices 100 and 110 are connected in a bidirectional communication manner. That is, downstairs resident can inform the upstairs neighbor of their state mode and so can acquire quietness from the upstairs neighbor exercising the care not to generate the noise. Similarly, the upstairs resident can feedback to the downstairs neighbor that he/she is not the source for the noise. Thus, it is possible to eliminate the unnecessary misunderstanding and distrust.

Alternatively, the first communication device 100 may be connected in a unilateral communication manner so that data can flow only from the first communication device 100 to the second communication device 110.

As the set of first and second communication devices 100 and 110 may be installed in the first and second floors respectively, another set of first and second communication devices 100 and 110 may be installed in the second and third floor respectively. Likewise, since the dispute over the noise may occur between neighbors living next to each other, the first and second communication devices 100 and 110 may be installed between houses next to each other.

The second communication device 110 may also include an input unit, a processing control unit, a display unit, and a communication unit as in the first communication device 100. However, the input unit of the second communication device 110 may have only one input interface capable of receiving only the feedback signal.

Referring to FIG. 3*a*, the state mode of the display unit 103 will be further described in more detail.

The green light 103*ac* indicates that the downstairs neighbor is in the considerate mode. The green light (103*ac*) occurs either when the downstairs neighbor is absent, or when the downstairs neighbor can tolerate the noise occurring upstairs for various reasons. The processed state of the considerate mode in the lower floor is transmitted to the upper floor through the second communication device 110, so that the upstairs neighbor can freely stay without fear of inducing the noise. As such, the green light 103*ac* means the considerate mode because it comes from the downstairs neighbor's consideration.

The yellow light 103*ab* and the red light 103*aa* may indicate that the downstairs neighbor is in non-considerate mode. More specifically, the yellow light 103*ab* signals that the downstairs neighbor is keen to the noise transmitted from the upper floor. Therefore, it means to ask the upstairs resident to be more cautious about making the noise. When the red light 103*aa* is switched ON from the yellow light, it may mean to actively request the upstairs neighbor to reduce the noise. These yellow lights 103*ab* and red lights 103*aa* are generated when downstairs neighbor presses a button with a finger, through a remote controller or a smartphone application, or automatically inputs by means of a motion or a sound detection sensor.

On the other hand, when the state mode is composed only of the green light 103*ac* and the red light 103*aa*, the red light 103*aa* may signal for not only informing the upstairs neighbor that the noise is bothersome, but also actively requesting to reduce the noise.

FIG. 4 is a timing chart showing an operation method of the display unit 103 in accordance with the input of the first communication device 100.

While there is no input to the input unit 101 (i.e., t0 to t1), the processing control unit 102 generates a control signal for lighting the green light 103*ac*. In this state, when a signal is generated in the input unit 101, the lighting signal of the green lamp 103*ac* is turned off, then the green lamp 103*ac* is turned off and the lighting signal of the yellow lamp 103*ab* is turned on. It is turned on and off repeatedly for a predetermined time (i.e., t1 to t2). After the point of time t2, the yellow lamp 103*ab* is kept in a lighted state. When an input signal is further generated in this state, the red light 103*aa* is flickered for a predetermined period of time t3 to t4 from the input time and is maintained in a lighted state. When there is no input signal for a predetermined time (i.e., t4 to t5), for example, 30 minutes after the time t4, the red light 103*aa* is turned off and the signal for the yellow light is ON. Similarly, when there is no user input signal for a predetermined time (i.e., t5 to t6) from the moment t5 when the yellow light 103*ab* is lit, the yellow light 103*ab* is turned OFF and the green light 103*ac* is turned ON. In an additional embodiment, when a step-by-step conversion occurs, the recorded voice, sound and various alarm sounds can be made to sound simultaneously with or without blinking.

Now, in order to resolve dispute over the noise travelling between neighbors, which has recently become a major social problem, how the data between neighbors according to the present invention is processed will be explained along with its advantages.

The downstairs resident can signal his or her tolerance as to the noise generated upstairs in almost real-time basis without having to go upstairs for complaining or notify security guards. Therefore, depending on the signal from the lower level, the upstairs neighbor can live freely without concern about causing the noise or can live up to consideration to the upstairs neighbors by trying to suppress the noise.

Specifically, while the downstairs neighbor is in the considerate mode, the upstairs resident can freely live without stress of causing the noise, thereby being thankful for care of the downstairs neighbor. On the other hand, when it is determined that the downstairs neighbor is in non-considerate mode, the upstairs neighbor will be able to keep himself or herself in harmony with his or her neighbor by paying attention not to causing the noise in return for care that the downstairs neighbor took for the upstairs resident.

In addition, based on the signal from the lower level upon any behavior happening upstairs, the upstairs resident can recognize immediately how much noise was transmitted to the neighbor and how much the downstairs neighbor was bothered or annoyed. As such, the upstairs resident will be able to adjust behaviors based on the signal from the upstairs.

Conventionally, there has been no way for the upstairs resident to be informed of the noise generated by him or herself in real time until the downstairs neighbor complains. Or, even if there was complaint, it was ambiguous to discern to what extent the noise was generated and transmitted. In contrast, according to the present invention, since it is possible to immediately know which particular behavior caused the processed state of the downstairs neighbor to change toward the non-considerate mode, i.e. blinking the yellow light, it can also prevent dissonance between family members upstairs resulted from unnecessary pushing for refraining from generating the noise.

In addition, if the processed state downstairs in most cases has been in the green light, i.e. usually the considerate mode, it is obvious for the upstairs resident to be thankful for consideration by the downstairs neighbor, so that it is easier for the downstairs neighbor to be able to request the noise reduction when necessary. Likewise, it is easier for the upstairs resident to accept the request and to try to behave more carefully.

Meanwhile, when the first communication device 110 turns the yellow light blinking, the upstairs neighbor may have two options. One is to reduce the noise and be quiet as much as possible in case that the noise was caused by oneself. The second is to give a feedback signal to the downstairs neighbor in case that the noise was not caused by oneself.

In other embodiment, the feedback signal is automatically made through the second communication device 110 when no signals from home IoT (Internet of Things) sensors, for instance, for motion detection are input to the second communication device 110.

Then, the second communication device 110 turns off the yellow light and turns the green light on and off. The signal for the green light is transmitted to the first communication device 100 through the communication unit 104, so that the first communication device 100 turns the green light on at the same time. Thus, the downstairs neighbor recognizes that the upstairs resident is not a noise source, thereby avoiding unnecessary misunderstandings from the downstairs neighbor. Likewise, it is advantageous that the upstairs neighbor can have the opportunity to actively and easily clarify who is responsible for the noise.

Table 1 shows the several state modes of downstairs neighbors and their advantages for each neighbor.

TABLE 1

| Scenarios | Advantages |
|---|---|
| Scenario 1: Absence & considerate mode | [Down] considerate mode → [Up] recognition → [Up] living without concern about causing noise |
| Advantage for downstairs | Accumulation of consideration (savings in consideration account)<br>Reserve right of request for noise reduction when necessary |
| Advantage for upstairs | Relief from stress of not causing noise<br>Increase of positive emotion for downstairs neighbor |
| Scenario 2: Staying-in & considerate mode | [Down] considerate mode → [Up] recognition → [Up] living without concern about causing noise |
| Advantage for downstairs | Accumulation of consideration (savings in consideration account)<br>Reserve right of request for noise reduction when necessary |
| Advantage for upstairs | Relief from stress of not causing noise<br>Increase of positive emotion for downstairs neighbor |
| Scenario 3: Non-considerate mode | [Down] non-considerate mode → [Up] recognition → [Up] Immediate reduction of noise → [Down] acquisition of quietness |
| Advantage for downstairs | Immediate and easy notification of request for noise reduction<br>Acquisition of quietness |
| Advantage for upstairs | Immediate and accurate recognition of noise generation<br>Prevention of dissonance between family members due to excessive suppression of behaviors |
| Scenario 4: Non-considerate mode & misunderstanding about noise source | [Down] non-considerate mode → [Up] recognition & feedback signal → [Down] receiving feedback |

TABLE 1-continued

| Scenarios | Advantages |
|---|---|
| Advantage for downstairs | Eliminate misunderstanding about noise source<br>No accumulation of complaints against upstairs neighbor |
| Advantage for upstairs | Clarification of noise source<br>Clearance of oneself of wrong complaints |

In the embodiment of FIG. 3*a*, since there is no input interface capable of receiving the (−) signal, the processed state of the first neighbor is automatically changed toward the considerate mode as a predetermined time passes. For example, the red light 103*aa* may be changed to the yellow light 103*ab* when the red light 103*aa* is turned on for 30 minutes, and the green light 103*ac* may be turned on for 30 minutes after the yellow light 103*ab* is turned on.

The time it takes for the state mode to change toward the considerate mode can be controlled by the user. This time may be adjusted differently for each state signal. For example, 10 minutes may be set for changing from a red light 103*aa* to a yellow light 103*ab*, and 30 minutes may be set for changing from a yellow light 103*ab* to a green light 103*ac*. By doing so, not only can it lead the downstairs resident to an increase in caring for the upstairs neighbors, but it also automatically allows the state mode to change toward the considerate mode even when the user forgets to change to the considerate mode in the non-considerate mode. Accordingly, it is possible to indicate more precisely the state mode of the downstairs neighbor.

Alternatively, the illuminated light of a certain state can be operated in a manner that it is maintained until the other light of another state is pressed.

FIG. 5*a* illustrates a first communication device 200 of a data processing apparatus between neighbors according to another embodiment of the present invention. The first communication device 200 according to this embodiment is different in that there is additionally an input interface 201*b* for variably controlling the quantity (or scale) of care.

As the scale of care is set higher, the time (i.e., t4-t5) for changing from the red to the yellow light or the time (i.e., t5-t6) for changing from the yellow to the green is shortened. That is, as the downstairs neighbor, who is the user of the first communication device 100, sets the scale of the care mind larger, the time indicated by the green light 203*c*, that is, the considerate mode becomes longer. In contrast, the smaller the scale of the care mind is set, the longer the non-considerate mode of yellow light 203*b* or the red light 203*a* is maintained.

It is human beings who believe that he or she is considerate for others or wants to be thoughtful. Such considerate or thoughtful behaviors are maximized when exchanged. As shown in FIGS. 5*a* and 5*b*, when the scale of consideration of the first communication device 200 or 300 can be set, users tend to set it higher and so be thoughtful for the upstairs neighbors. In return, the upstairs neighbors can also be induced to suppress generating the noise upon the downstairs neighbors' request, thereby avoiding disputes over the noise. That is, a kind consideration of one leads to another consideration of the other neighbor, and thus the dispute over the noise between neighbors can be fundamentally prevented.

Referring to FIG. 5*a*, the scale of consideration can be adjusted by a dial. Alternatively, it can be adjusted by a sliding bar as in FIG. 5*b*.

Referring now to FIG. 6, the operation method of an apparatus for processing data between neighbors illustrated in FIG. 5*a* will be described with the first communication apparatuses 200 and 300.

The downstairs resident sets the scale of the first communication devices 200 or 300 to a predetermined value (s10). If that resident hears or feels noises travelled from upstairs while feeling in the mood of being quiet, a signal from the downstairs resident may be input to the first communication device 200. Then, in case that the green light 203*c* is ON in the first communication devices 200 and 300, the green light 203*c* is turned off and the yellow light 203*b* is to be blinking. Likewise, in case that the yellow light 203*b* is ON, the yellow light 203*b* is turned off and the red light 203*a* is to be blinking (s15). In case that the red light 203*a* is ON, the red light 203*a* is to rapidly flicker(s17).

A signal indicating the state mode of the first communication devices 200 or 300 is transmitted to the second communication device 110 and the processed state is displayed on the second communication device 110. This allows the upstairs neighbor to recognize the state of downstairs. If the second communication device 110 turns the green light on, the upstairs neighbor can recognize that the downstairs neighbor is absent, or the noise is not so loud as the downstairs neighbor would be bothered. Thus, the upstairs resident can live freely without having to worry about making noise. On the other hand, when a yellow light or a red light is on in the second communication device 110, the upstairs neighbors will recognize that the downstairs neighbor is present and the behavior on the upper floor caused the noise and the noise was conveyed to the downstairs neighbor. That is, in the present invention the upstairs resident to react differently based on a feedback signal from the downstairs neighbor which is represented by the processed state, thus dissonance between upstairs family members resulted from unnecessary pushing for refraining from generating the noise can be prevented and the downstairs neighbor can obtain quietness in the present invention, as opposed to the conventional situation where upstairs family members may unnecessarily force children to not make noise without knowing the state of downstairs.

When, without any signal input to the first communication devices 200, 300, a predetermined time lapses, it determines if the red light 203*a* is ON. (s18) If the red light 203*a* is ON, the red light 203*a* is turned off and the yellow light 203*b* is turned on. (s20) Alternatively, If the yellow light 203*b* is ON, the yellow light 203*b* is turned off and the green light 203*c* is turned on. (s22) Here, the fact that any signal is not input the first communication devices 200, 300 means the downstairs neighbor is absent or the current noise transmitted to the lower floor is not so a big problem as the neighbor would care.

As such, in response to any action on the upper floor, the processed state of being the considerate mode is transmitted to the upper floor in nearly a real time, and so this allows the upstairs neighbors to be able to live without having to worry about causing the noise. Moreover, since the upstairs neighbor have accumulated the positive emotions for the downstairs neighbors who had been considerate, the upstairs neighbor is more willing to be in harmony with the downstairs neighbors when receiving request for noise reduction.

Referring to FIG. 7, the operation method of an apparatus for processing data between neighbors illustrated in FIG. 5*a* will be described with the second communication device 110.

The second communication device 110 determines whether there is an input from the upstairs neighbor or IoT (Internet of Things) sensors. (s30) Upon detection of the input from the upstairs neighbor, if the current state mode is red, the processing control unit generates an OFF signal for the red light and a blinking signal (ON & OFF) for the yellow light. (s32) If the current state mode is yellow, the processing control unit outputs an OFF signal for the yellow light and a blinking signal (ON & OFF) for the green light. (s34) This signal is transmitted to the first communication device 100 and displayed on it at the same time as on the second communication device 110. Alternatively, if it is a default setting that an input is provided by home IoT (Internet of Things) sensors automatically instead of by the upstairs neighbor manually, the procedure goes in the same way as the above when no signal from the home IoT (Internet of Things) sensors is detected.

The signal input to the second communication device 110 is a feedback signal from the upstairs residents to the processed state signal transmitted from the first communication device 100. This feedback signal may occur when the upstairs resident is not a noise source. Since the feedback signal is displayed on the first communication device 100, the downstairs neighbor can recognize that the noise just before was not generated on the upper floor. This prevents unnecessary misunderstandings for the noise source and prevents the downstairs neighbor from accumulating complaints for the upstairs neighbors. On the other hand, the upstairs resident has a means to proactively inform the fact that they are not a noise source and thus can solve the problem being misunderstood for the noise source.

In the meantime, if no feedback signal is input to the second communication device 110, it is determined whether a predetermined time has lapsed. (s35) If the predetermined time has passed and the current state mode is blinking red, then the processing control unit generates an ON signal for the red light. If the current state mode is blinking yellow, then the processing control unit generates an ON signal for the yellow light. (s39)

The 'blinking' light of a certain state mode occurs when an input is received at the pairing communication device, while the ON light is generated when a predetermined time has elapsed without any additional input after an initial input. For example, if a noise travelling between neighbors is detected in a state mode of the green light ON and an input is received by the first communication device 100, 200, 300, then the yellow light blinks for a predetermined time and afterwards the yellow light will remain ON.

Similarly, if a feedback signal is input from the upstairs neighbor to the second communication device 110 in a state mode of the yellow light ON, the yellow light is turned off and the green light is switched to flash on and off on the first and second communication devices 100 and 110. As such, the upstairs neighbor can surely recognize whether or not the preceding action on the upper floor caused the noise travelling between neighbors because when any input is detected, the light flashes on and off for a predetermined time thereafter. Likewise, it is advantageous that the downstairs neighbor can surely recognize whether or not the upstairs is the source of the just preceding noise.

Alternatively, it is also possible to display the time of occurrence of the most recently input signal instead of distinguishing between blinking and lighting ON. In this case, the upstairs neighbors can more accurately see the correlation between the behavior and the caused noise on the upper floor. Alternatively, an alarm sound may be generated, or an event push signal may be provided to a smart phone or a smart TV as the input signal is detected.

FIG. 8 is a diagram schematically showing a first communication device 400 of an apparatus for processing data between neighbors according to another embodiment of the present invention. It is different from FIG. 5*a* in that the first communication device 400 is additionally provided with interfaces 401*a*, 401*b*, 401*c*, and 401*d* showing the types of noise travelling between neighbors. For example, there may be a typical noise from children's running, b, smoking, sound of musical instruments, or dog's barking.

In this embodiment as well, since apparatuses on the upper and lower floors are operatively coupled with each other so that the processed state mode are displayed in the same manner, it is possible to prevent a type of noise in issue from being confused with a different type of noise.

Each I/O interface may be provided for each type of noises. For example, there are four input buttons 401*a*, 401*b*, 401*c* and 401*d* for selecting the type of noises, and there are corresponding output sections 403*a*, 403*b*, 403*c* and 403*d* for indicating that the certain type of noise is being selected. As an exemplary, when the button 401*a* is pressed, lamp 403*a* indicating the noise is turned on and the state mode of the processed state with respect to the noise between neighbors operates as described in the foregoing. If the user presses the smoking button 401*b*, the smoking lamp 403*b* is turned on.

FIG. 9 illustrates another way of inputting a feedback signal to the second communication device 110.

A motion detection sensor 51, a sound detection sensor 53, a motion detector with video analytics 52, etc. may be installed and networked with the second communication device 110 in order to detect the presence or absence of a person. Referring to FIG. 10, a plurality of motion sensors 151, 152, 153, 154, and 155 may be installed in the front door, the living room, the kitchen, and the rooms on the upper floor, respectively. If no motion is detected from any of the detection sensors, it is determined that the person is absent, and if the motion is detected from any one of the detection sensors, it can be determined that the person is present on the upper floor.

If a signal indicating the noise occurrence is input from the first communication device 100 and so the yellow light or red light of is flashing on and off on the second communication device 110, but the upstairs resident is absent, it means that the upper floor is not the noise source. Even when the upstairs resident is absent and so cannot proactively clarify whether or not he is the noise source, if no signal is input from the sensor connected to the second communication device 110, the second communication device 110 processes and outputs a signal of the state mode indicating the upstairs resident's absence and transmits it to the first communication device 100. As such, the feedback signal to the first communication device 100 may be input directly by the upstairs neighbor or be input by the detection unit.

In another embodiment, instead of the above-described sensors, the upstairs resident recognizes the processed state of the downstairs neighbor through a smartphone application 54 wirelessly connected to the first communication device 100. Then, the upstairs resident may input a signal indicating he or she is not a noise source into your smartphone application.

As will be appreciated by those skilled in the pertinent art, the scope of the present invention is not limited to the embodiments described herein, but may be variously modified, rearranged and replaced without departing from the scope of the present invention. For example, although the present invention has been described with respect to pairing communication devices each of which is a stand-alone device, the scope of the present invention is not limited thereto.

The present invention can be implemented using a pair of smartphone applications instead of the first and second communication devices 100, 110. Specifically, functionalities of the first communication device 100 may be implemented in the smartphone application 500 of the downstairs neighbor, and functionalities of the second communication device 110 may be implemented in the smartphone application of the upstairs neighbor. This is possible only if the neighbors between neighbors install the corresponding smartphone applications on his own smartphone and register each other as a counterpart neighbor.

In an embodiment of the smartphone application, the first communication device 500 may be implemented as illustrated in FIG. 11. The input unit 501 requesting the noise reduction may be variously configured such as 'Hearing noise' and 'Feel too noisy', for example. When the 'Hearing noise' signal is input, the upstairs neighbor will be able to immediately recognize whether the current upstairs behavior is causing noise travelling between neighbors.

In addition, the consideration accounts 503*d* and 503*e* of the downstairs neighbor may be additionally provided. The consideration account can quantify accumulated consideration for the upstairs neighbor and indicate it. For example, the accumulated consideration of the consideration account can be increased or decreased depending on a time during which the green light is turned on. Alternatively, the accumulated consideration of the consideration account can be configured to be increased or decreased depending on the number of the green light ON, the number of the yellow light ON, or the number of the red light ON. In the embodiment of FIG. 11, the account of today 503*e* in the right bottom indicates a degree of thoughtfulness in one day, and the account of accumulations 503*d* in the left bottom indicates the number of hearts accumulated over days. A full degree of thoughtfulness in the heart 503*e* each day accounts for one heart in the account of accumulations. The accumulated consideration accounts 503*d* can be utilized in various ways. For example, a kind of rewarding may be provided based on the number of hearts in the consideration account 503*d*, or it may be utilized in transactions of real estate as a token or index of thoughtfulness for neighbors.

In another embodiment, in case that the consideration account is run out and it is repeated several times (for example, a three strike-out system), communication devices of the present invention may be set to be stopped or deactivated in operation in order to prevent misuse and side effect of the devices. In this case, users may have options to visit a service center in order to reactivate devices or may get refund for a portion of original price.

In another embodiment, the second communication device 110 can be replaced by the smartphone application and the first communication device 100 can be a stand-alone device.

Alternatively, the first and second communication devices 100 and 110 may be implemented in a smart home-panel system built in walls of apartments instead of a stand-alone device.

The operations or steps of the methods or algorithms described above can be embodied as computer readable codes on a computer readable recording medium, or to be transmitted through a transmission medium. The computer readable recording medium is any data storage device that can store data which can be thereafter read by a computer system. Examples of the computer readable recording medium include read-only memory (ROM), random-access memory (RAM), compact disc (CD)-ROM, digital versatile disc (DVD), magnetic tape, floppy disk, and optical data storage device, not being limited thereto. The transmission medium can include carrier waves transmitted through the Internet or various types of communication channel. The computer readable recording medium can also be distributed over network coupled computer systems so that the computer readable code is stored and executed in a distributed fashion.

While the above exemplary embodiments have been described with reference to the drawings, it will be understood by those of ordinary skill in the art that various changes in form and details may be made therein without departing from the spirit and scope of the inventive concept as defined by the following claims.

What is claimed is:

1. An apparatus for processing data between a first neighbor in a first space and a second neighbor in a second space, the apparatus comprising:

a first communication device in the first space including a processor that collects information on a state of the first neighbor in the first space through an input interface, processes the information on the state of the first neighbor, and transmits the processed information on the state of the first neighbor in the first space to a display unit; and a second communication device, in the second space spatially separated from the first space, including a communication interface that communicates data with the first communication device and a display that simultaneously displays the processed information on the state of the first neighbor transmitted from the first communication device to the second neighbor;

wherein the processed information on the state of the first neighbor represents a degree of tolerance by the first neighbor over noise travelling between the first and second neighbors.

2. The apparatus of claim 1, wherein the processed information on the state of the first neighbor comprises information on at least two states.

3. The apparatus of claim 2, wherein the at least two states are indicated by at least two different color indicators, respectively.

4. The apparatus of claim 1, wherein the first communication device and the second communication device are communicated exclusively to each other so that data is transmitted and received only between the first communication device and the second communication device.

5. The apparatus of claim 1, wherein the information on the state of the first neighbor includes a signal received from at least one sensor in association with the first space.

6. The apparatus of claim 1, wherein the input interface of the first communication device additionally receives a scale parameter for consideration, and wherein the processor of the first communication device changes the processed information on the state of the first neighbor when the information on the state of the first neighbor is not input for a predetermined time period in such a manner that a rate of changing of the processed information on the state of the first neighbor is adjusted based on the scale parameter for consideration.

7. The apparatus of claim 1, wherein the second communication device further comprises an input interface that receives a feedback signal for the processed information on the state of the first neighbor from the second neighbor, and the communication interface of the second communication device transmits the feedback signal to the first communication device.

8. The apparatus of claim 7, wherein the first communication device further comprises the display on which the processed information on the state of the first neighbor is displayed, and wherein each of the displays of the first and second communication devices displays the processed information on the state of the first neighbor in such a manner that when the processed information on the state of the first neighbor is changed due to the input of the information on the state of the first neighbor or the feedback signal, the first neighbor or the second neighbor can recognize the change in the processed information on the state of the first neighbor for a predetermined time from the point in time when the processed information on the state of the first neighbor is changed.

9. The apparatus of claim 1, wherein the processed information on the state of the first neighbor does not include information on absence of the first neighbor in the first space or noise quantity travelling between neighbors.

10. The apparatus of claim 1, wherein the first communication device further comprises the display on which the processed information on the state of the first neighbor is displayed, wherein the display of the first communication device displays a consideration account in which consideration for the second neighbor is accumulated and quantified, wherein an operation of the first communication device is restricted when a remaining amount of the consideration account falls below a predetermined amount.

11. A method of processing data between a first neighbor in a first space and a second neighbor in a second space comprising:

receiving, by a first communication device, information on a state of the first neighbor in the first space through an input interface;

processing, by the first communication device, the information on the state of the first neighbor into a processed state of the first neighbor through a processor;

displaying by the first communication device, the processed information on the state of the first neighbor on a display;

transmitting, by the first communication device, the processed information on the state of the first neighbor through a communication interface to a second communication device;

receiving the processed information on the state of the first neighbor by the second communication device communicatively connected with the first communication device and disposed in the second space from which the first space is spatially separated; and displaying, by the second communication device, the processed information on the state of the first neighbor to the second neighbor at the same time as the first communication device displays that same processed state to the first neighbor, wherein the processed information on the state of the first neighbor represents a degree of tolerance by the first neighbor over noise traveling between the first and second neighbors.

12. The method of claim 11, wherein the processed information on the state of the first neighbor includes information on at least two states representing the degree of tolerance by the first neighbor located in the first space as to such inconvenience as the noise travelling between the first and second neighbors.

13. The method of claim 11, wherein the first and second communication devices are exclusively communicatively coupled with each other to transmit and receive data, and wherein the processed information on the state of the first neighbor does not include information on absence of the first neighbor in the first space or noise quantity travelling between the first and second neighbors.

14. The method of claim 11, wherein the information on the state of the first neighbor includes a signal received from at least one sensor in association with the first space.

15. The method of claim 11, wherein the second communication device further comprises an input interface that receives a feedback signal for the processed information on the state of the first neighbor from the second neighbor, and the communication interface of the second communication device transmits the feedback signal to the first communication device.

16. The method of claim 11, further comprising:

a step of additionally receiving a scale parameter for consideration by the first communication device, and changing the processed information on the state of the first neighbor through the processor of the first communication device, and wherein the processor of the first communication device changes the processed information on the state of the first neighbor when the information on the state of the first neighbor is not input for a predetermined time period in such a manner that a rate of changing of the processed information on the state of the first neighbor is adjusted based on the scale parameter for consideration.

17. A communication system comprising a set of pairing communication devices which communicate with each other and display a processed information on a state of at least one of a first neighbor in a first space and a second neighbor in a second space, from which the first space is spatially separated, on each pairing communication device at the same time, wherein the set of pairing communication devices comprises a first communication device for the first neighbor in the first space and a second communication device for the second neighbor in the second space, and wherein the first neighbor shares the processed information on the state, representing a degree of tolerance as to noise travelling between the first and second neighbors, with the second neighbor in such a manner that:

the processed information on the state of the first neighbor is displayed on the first communication device and transmitted by the first communication device to the second communication device to be displayed on the second communication device, and the processed information on the state of the second neighbor is displayed on the second communication device and transmitted by the second communication device to the first communication device to be displayed on the first communication device.

18. The method of claim 17, wherein the first communication device comprises:

an input interface receiving information on a state of the first neighbor;

a processor processing the information on the state of the first neighbor to output the processed state of the first neighbor; and a display displaying the processed state of the first neighbor; and a communication interface communicating with the second communication device bi-directionally, and wherein the second communication device comprises:

a display displaying the processed state of the first neighbor received from the first communication device;

an input interface receiving a feedback signal from the second neighbor; and a communication interface communicating with the first communication device bi-directionally.

19. The method of claim 18, wherein the information on the state of the first neighbor includes a signal received from at least one sensor in association with the first space.

20. The method of claim 18, wherein the input interface of the first communication device receives a scale parameter for consideration to be input to the processor, and wherein the processor of the first communication device changes the processed information on the state of the first neighbor when the information on the state of the first neighbor is not input for a predetermined period of time in such a manner that a rate of changing of the processed state of the first neighbor is adjusted based on the scale parameter for consideration.

* * * * *